US005337899A

United States Patent [19]

Andersson et al.

[11] Patent Number: 5,337,899

[45] Date of Patent: Aug. 16, 1994

[54] HYDROCYCLONE PLANT

[75] Inventors: Roine Andersson, Järfälla; Lars-Göran Rundqvist, Tumba, both of Sweden

[73] Assignee: Celleco-Hedemora AB, Stockholm, Sweden

[21] Appl. No.: 50,188

[22] PCT Filed: Nov. 26, 1991

[86] PCT No.: PCT/SE91/00803

§ 371 Date: May 5, 1993

§ 102(e) Date: May 5, 1993

[87] PCT Pub. No.: WO92/09371

PCT Pub. Date: Jun. 11, 1992

[30] Foreign Application Priority Data

Nov. 26, 1990 [SE] Sweden ..... 9003746-6

[51] Int. Cl.[5] ..... B04C 5/28

[52] U.S. Cl. ..... 209/728; 210/512.2; 209/734

[58] Field of Search ..... 209/144, 198, 199, 211; 210/512.2, 512.1

[56] References Cited

U.S. PATENT DOCUMENTS 3,486,618 12/1969 Wikdahl ..... 209/211 X
4,189,377 2/1980 Dahlberg et al. ..... 210/512.2 X
4,190,523 2/1980 Niemeijer ..... 209/211
4,260,480 4/1981 Lewis et al. ..... 210/512.2 X
4,285,706 8/1981 Dehne ..... 210/512.2 X
4,372,845 2/1983 Fecske ..... 209/211
4,426,283 1/1984 Fecske ..... 209/211

FOREIGN PATENT DOCUMENTS 2108464 11/1985 Fed. Rep. of Germany ..... 209/211
9107231 5/1991 PCT Int'l Appl. ..... 209/211

*Primary Examiner*—D. Glenn Dayoan
*Assistant Examiner*—Tuan N. Nguyen
*Attorney, Agent, or Firm*—Davis Hoxie Faithfull & Hapgood

[57] ABSTRACT

A hydrocyclone plant comprises a multiplicity of hydrocyclones arranged in groups of at least two hydrocyclones, each group being made in a single piece. The hydrocyclones extend substantially radially in an annular space for a liquid mixture to be separated. The inlet space extends concentrically around a cylindrical heavy fraction space for receiving a heavy fraction of the liquid mixture from the hydrocyclones. According to the invention, the hydrocyclone groups are distributed around the cylindrical heavy fraction space in the circumferential direction and are spaced from one another in the inlet space to allow the liquid mixture to flow between adjacent hydrocyclone groups.

4 Claims, 2 Drawing Sheets

HYDROCYCLONE PLANT

FIELD OF THE INVENTION

The present invention relates to a hydrocyclone plant, comprising a multiplicity of hydrocyclones arranged in groups of at least two hydrocyclones, each hydrocyclone having an elongated separation chamber with two opposite ends, at least one inlet for a liquid mixture to be separated, a light fraction outlet at one end of the separation chamber for a created light fraction and a heavy fraction outlet at the other end of the separation chamber for a created heavy fraction. There are walls defining a cylindrical heavy fraction space, which communicates with the heavy fraction outlets, an annular inlet space, which extends concentrically around the heavy fraction space and communicates with the inlets of the hydrocyclones, and an annular light fraction space, which extends concentrically around the inlet space and communicates with the light fraction outlets. Each hydrocyclone extends substantially radially in said annular inlet space, and each group of hydrocyclones is made in one single piece.

BACKGROUND OF THE INVENTION

A hydrocyclone plant of the general kind described is known from U.S. Pat. No. 4,190,523, in which each hydrocyclone group forms a disc having a number of radially oriented hydrocyclones, said disc-shaped hydrocyclone groups being stacked. This known plant is not practical to use for applications which require relatively long hydrocyclones, since the discs would be too large and heavy. For instance, when cleaning fiber pulp suspensions by means of this plant, the required long hydrocyclones would result in discs having a diameter exceeding two metres. Such large discs would be difficult to disassemble from the stack of discs for servicing and repairing individual hydrocyclones. The object of the present invention is to provide a hydrocyclone plant of this kind, which is compact, is suited for relatively long hydrocyclones, and enables easy servicing of the individual hydrocyclones.

SUMMARY OF THE INVENTION

In accordance with the invention, the foregoing object is obtained by means of a hydrocyclone plant of the kind initially stated, which mainly is characterized in that the groups of hydrocyclones are distributed around the cylindrical heavy fraction space in the circumferential direction and are spaced from one another in the inlet space to allow the liquid mixture to flow between adjacent groups of hydrocyclones.

Each group of hydrocyclones preferably comprises three hydrocyclones, and is releasably attached to said walls.

Each hydrocyclone is suitably designed with a cylindrical chamber, which communicates directly with the inlet and the light fraction outlet, and a tapered chamber, which communicates directly with the heavy fraction outlet, the cylindrical chambers in each group of hydrocyclones extending in parallel with one another, whereas the centre axes of the tapered chambers of the group converge in direction towards the apexes of the tapered chambers. In this manner the hydrocyclones of each group of hydrocyclones can be packed closer to one another.

In each hydrocyclone the central axis of the cylindrical chamber and the central axis of the tapered chamber suitably form an angle to one another, such that in an axial section through the hydrocyclone the wall of the chambers coincide with a straight line.

BRIEF DESCRIPTION OF THE DRAWINGS

The invention will be described more closely with reference to the accompanying drawings in which.

DESCRIPTION OF THE PREFERRED EMBODIMENTS

Figure 1:
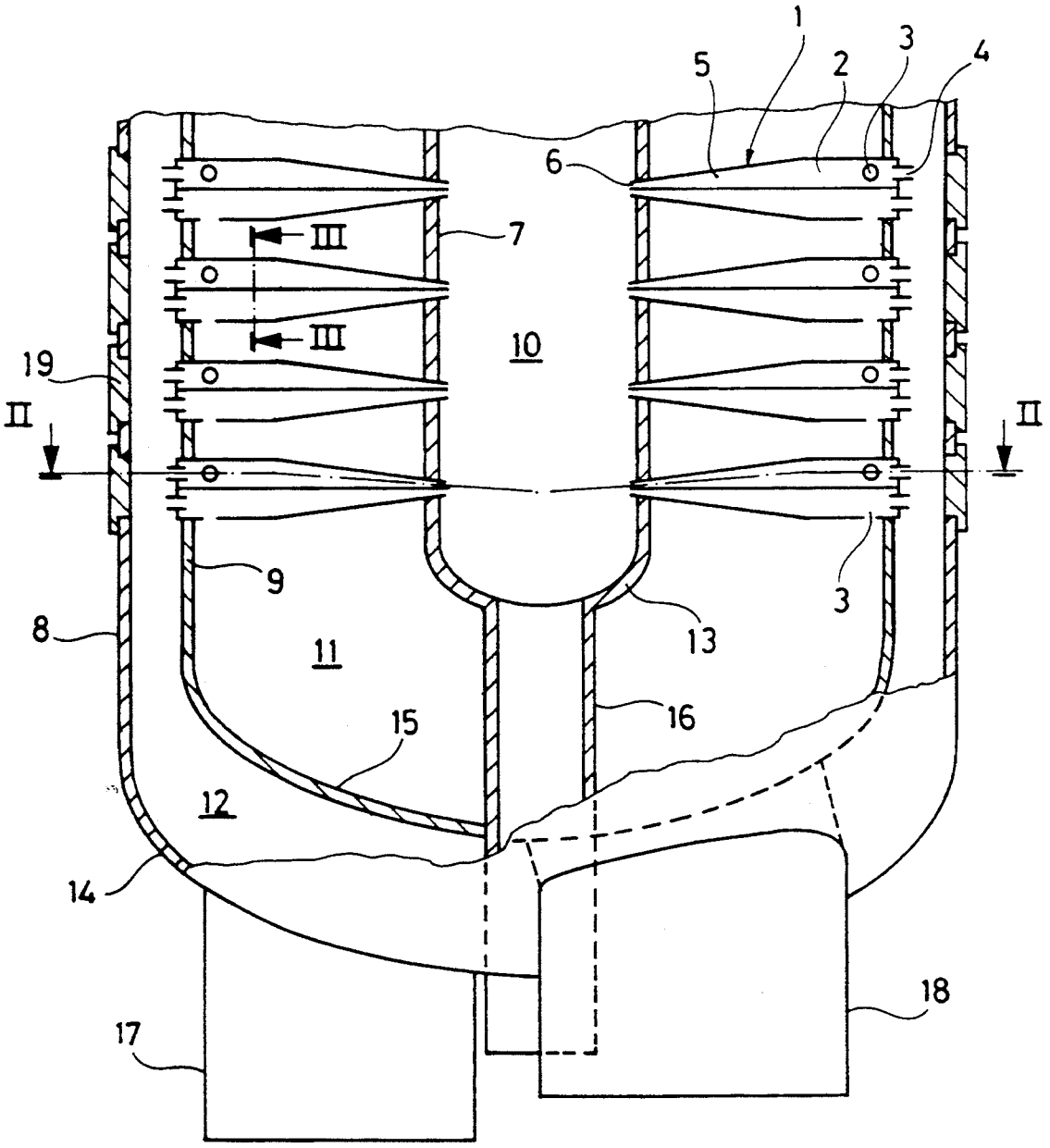
FIG. 1 schematically shows a section of a hydrocyclone plant according to the invention.
Figure 2:
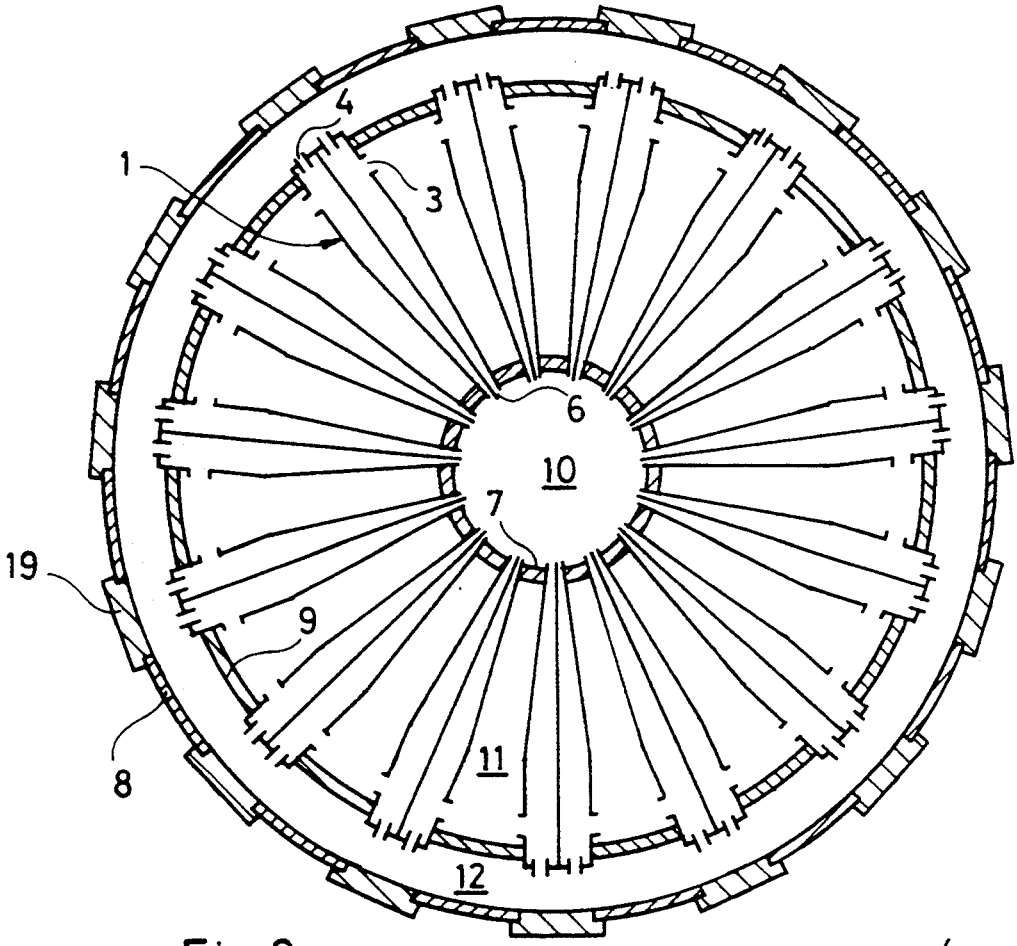
FIG. 2 is a section along the line II—II in FIG. 1.

The hydrocyclone plant shown in the figures comprises a number of elongated hydrocyclones 1 arranged in groups of three hydrocyclones. Each hydrocyclone 1 has a separation chamber consisting of a cylindrical chamber 2 and a conical chamber 5. The cylindrical chamber 2 has a peripheral inlet 3 for a liquid mixture to be separated and a central light fraction outlet 4 for a created light fraction. The conical chamber 5 has a heavy fraction outlet 6 at the apex of the conical chamber 5 for a created heavy fraction. Three cylindrical vertical walls, an inner wall 7, an outer wall 8 and an intermediate wall 9 are arranged concentrically with one another and define a cylindrical heavy fraction space 10 in the interior of the inner wall 7, an annular inlet space 11 between the inner wall 7 and the intermediate wall and an annular light fraction space 12 between the intermediate wall 9 and the outer wall 8. The walls 7–9 are provided with bottom walls 13–15, which have an outlet member 16 for heavy fraction, and outlet member 17 for light fraction and an inlet member 18 for the liquid mixture to be separated.

The groups of hydrocyclones 1 extend substantially radially in the annular inlet space 11 and are evenly distributed around the cylindrical heavy fraction space 10 on several levels along the cylindrical walls 7–9.

Figure 3:
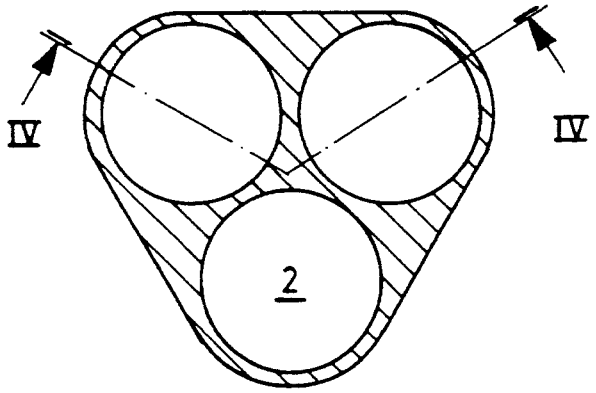
FIG. 3 is a section along the line III—III in FIG. 1.

The inlet 3, the heavy fraction outlet 6 and the light fraction outlet 4 of the hydrocyclones communicate with the inlet space 11, the heavy fraction space 10 and the light fraction space-12, respectively. Each group of hydrocyclones is made in one single piece (FIG. 3 and 4), which is releasable from the hydrocyclone plant via a hole arranged in the outer wall 8 in front of said piece. Said hole is normally closed by a lid 19.

Figure 4:
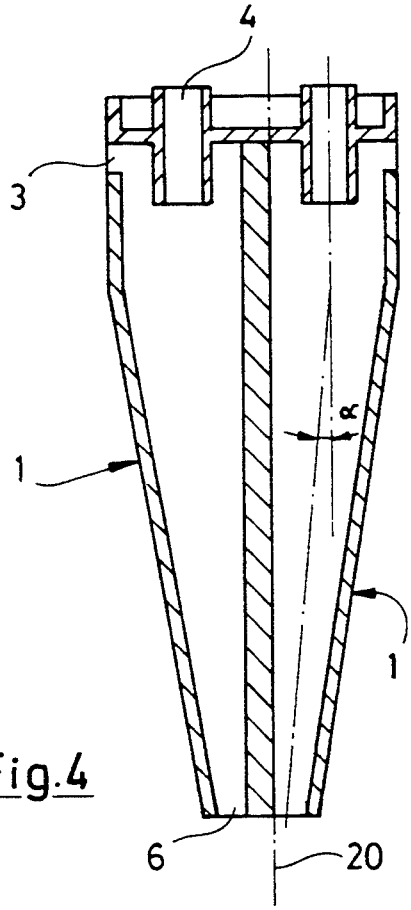
FIG. 4 is a section along the line IV—IV in FIG. 3.

In each group of hydrocyclones 1 the cylindrical chambers 2 extend in parallel with one another, whereas the centre axes of the conical chambers 5 converge in direction towards the apexes of the conical chambers 5. In each hydrocyclone 1 the centre axis of the cylindrical chamber 2 and the centre axis of the conical chamber 5 form an angle $\alpha$ to one another, such that in an axial section through the hydrocyclone 1 the wall of the chambers 2,5 coincide with a straight line 20 (FIG. 4).

During operation the liquid mixture to be separated is pumped to the inlet space 11 via the inlet member 18. In the inlet space 11 the liquid mixture flows under a relatively little flow resistance between the groups of hydrocyclones to the individual hydrocyclones 1 and enters these via the inlets 3. In the hydrocyclones 1 the liquid mixture is separated into a light fraction and a heavy fraction, which flows through the heavy fraction outlet 6 and which is collected in the heavy fraction space 10, from which the heavy fraction is discharged from the hydrocyclone plant via the outlet member 16. The light fraction flows through the light fraction outlet 4 and is collected in the light fraction space 12, from which the light fraction is discharged from the hydrocyclone plant via the outlet member 17.

We claim:

1. A hydrocyclone plant for separating a liquid mixture into a heavy fraction and a light fraction, said plant comprising:

a multiplicity of elongated hydrocyclones arranged in groups of at least two hydrocyclones, each group of hydrocyclones being made in a single piece, each hydrocyclone having an elongated separation chamber with two opposite ends, at least one inlet for a liquid mixture to be separated, a light fraction outlet at one end of the separation chamber for a light fraction and a heavy fraction outlet at the other end of the separation chamber for a heavy fraction, and walls defining a cylindrical heavy fraction space communication with the heavy fraction outlets, an annular inlet space extending concentrically around said heavy fraction space and communicating directly with the inlets of the hydrocyclones, and an annular light fraction space extending concentrically around said annular inlet space and communicating with the light fraction outlets, each hydrocyclone extending substantially radially in said annular inlet space, said groups of hydrocyclones being distributed around the circumference of the cylindrical heavy fraction space and being spaced from one another in said annular inlet space to allow said liquid mixture to flow between adjacent groups of hydrocyclones.

2. A hydrocyclone plant according to claim 1, wherein each group of hydrocyclones comprises three hydrocyclones and is releasably attached to said walls.

3. A hydrocyclone plant according to claim 1, wherein each separation chamber comprises a cylindrical chamber communicating directly with the inlet for the liquid mixture and the light fraction outlet, and a tapered chamber communicating directly with the heavy fraction outlet the cylindrical chambers of each group of hydrocyclones extend in parallel with one another, and the central axes of the tapered chambers converge towards the pieces of the tapered chambers.

4. A hydrocyclone plant according to claim 3, wherein the central axes of the cylindrical and tapered chambers of each hydrocyclone form an angle with one another, such that in an axial section through the hydrocyclone the wall of the chambers coincide with a straight line.

* * * * *

UNITED STATES PATENT AND TRADEMARK OFFICE

CERTIFICATE OF CORRECTION

PATENT NO. : 5,337,899

DATED : August 16, 1994

INVENTOR(S) : Andersson et al.

It is certified that error appears in the above-identified patent and that said Letters Patent is hereby corrected as shown below:

| | | |
|---|---|---|
| Col. 2, | line 33, | after "wall", insert --9,--. |
| Col. 3, | line 22 | (Claim 1) cancel "communication" and substitute --communicating--. |
| Col. 4, | line 20 | (Claim 3) cancel "pieces" and substitute --apices--. |

Signed and Sealed this

Twentieth Day of December, 1994

*Attest:*

Bruce Lehman

BRUCE LEHMAN

*Attesting Officer*

*Commissioner of Patents and Trademarks*